United States Patent [19]

Stern et al.

[11] Patent Number: 4,755,827

[45] Date of Patent: Jul. 5, 1988

[54] MILLIMETER WAVELENGTH MONOLITHIC FERRITE CIRCULATOR/ANTENNA DEVICE

[75] Inventors: Richard A. Stern, Allenwood; Richard W. Babbitt, Fairhaven, both of N.J.

[73] Assignee: The United States of America as represented by the Secretary of the Army, Washington, D.C.

[21] Appl. No.: 10,674

[22] Filed: Feb. 4, 1987

[51] Int. Cl.[4] ..... H01Q 13/00

[52] U.S. Cl. ..... 343/785; 343/787; 343/770

[58] Field of Search ..... 343/785, 787, 788, 768, 343/770

[56] References Cited

U.S. PATENT DOCUMENTS

| | | | |
|---|---|---|---|
| 3,761,938 | 9/1973 | Reggia | 343/785 |
| 3,855,597 | 12/1974 | Carlise | 343/787 |
| 4,415,871 | 11/1983 | Stern et al. | 333/248 |
| 4,424,517 | 1/1984 | Stern et al. | 343/771 |
| 4,658,263 | 4/1987 | Urbanski | 343/788 |
| 4,691,208 | 9/1987 | Stern et al. | 343/785 |

*Primary Examiner*—William L. Sikes
*Assistant Examiner*—Hoanganh Le
*Attorney, Agent, or Firm*—Sheldon Kanars; Robert A. Maikis

[57] ABSTRACT

A millimeter wavelength monolithic ferrite circulator-/antenna device is provided comprising a four-sided ferrite rod having one end which is to be selectively coupled to millimeter wavelength radar transmitter and receiver apparatus and the other end coupled to a load. The rod end coupled to the radar apparatus has a pair of permanent magnets disposed on opposite sides of the rod and is shaped as a right prism having prism bases formed by sections of the rod sides on which the magnets are mounted and prism faces formed by sections of the remaining two rod sides and by the cross-section of the rod itself. The dc magnetic field produced by the magnets is perpendicular to the longitudinal axis of the rod and causes the prism to act as a ferrite circulator with respect to millimeter wave energy transmitted through the prism faces and along such rod axis. The remainder of the rod is utilized as a ferrite rod antenna of the leaky-wave type by providing energy emitting perturbations on one of the rod sides.

8 Claims, 2 Drawing Sheets

MILLIMETER WAVELENGTH MONOLITHIC FERRITE CIRCULATOR/ANTENNA DEVICE

STATEMENT OF GOVERNMENT RIGHTS

The invention described herein may be manufactured, used and licensed by or for the Government for governmental purposes without the payment of any royalties thereon.

BACKGROUND OF THE INVENTION

1. Field of the Invention

This invention relates to radar antenna subsystems designed in ferrite type dielectric waveguide transmission line for millimeter wave frequency applications and more particularly to an integrated ferrite circulator/antenna device which functions as both a circulator and an antenna for such millimeter wave frequency applications.

2. Description of the Prior Art

U.S. Pat. No. 4,415,871, issued Nov. 15, 1983 to Richard A. Stern and Richard W. Babbitt, the inventors of the present application, and assigned to the assignee of the present application, describes a ferrite type of circulator device which may be used in millimeter wave frequency applications designed in dielectric waveguide, such as radar system front ends, for example. The circulator device essentially comprises a ferrite right prism having polygonal shaped bases and at least three prism faces which are of equal size and shape. When a dc magnetic field is applied between the bases of the ferrite prism, a non-reciprocal coupling action between the prism faces or "circulator ports" results. The non-reciprocal coupling action is such that an input signal applied to a first port is coupled to a second adjacent port but is effectively isolated from the third port. Similarly, a signal applied to the second port is coupled to the third port but is effectively isolated from the first port. As explained in said U.S. Pat. No. 4,415,871, circulators of this type may be used to couple the transmitter and the receiver of a radar system to the radar antenna by utilizing lengths of dielectric waveguide between the circulator ports and the transmitter, receiver and antenna apparatus.

U.S. Pat. No. 4,424,517, issued Jan. 3, 1984 to the said Richard A. Stern and Richard W. Babbitt and assigned to the assignee of the present application, shows an integrated dielectric waveguide radar front end device utilizing a ferrite circulator having the circulator ports coupled to the radar transmitter and radar receiver by lengths of non-ferrite, dielectric waveguide. The radar antenna also consists of a section of non-ferrite, dielectric waveguide having a series of perturbations extending along one of the sides of the section which radiate the radar signal. The antenna itself is coupled directly to the antenna port of the circulator since the dielectric waveguide materials selected for the antenna section and the input and output waveguide sections of the circulator are fabricated of a low loss dielectric material having a dielectric constant which is closely matched to the dielectric constant of the ferrite circulator material.

U.S. patent application Ser. No. 640,183, filed Jul. 2, 1984 by the said Richard A. Stern and Richard W. Babbitt and assigned to the assignee of the present application, now U.S. Pat. No. 4,691,208, discloses a radar scanning antenna comprising a ferrite rod having a series of perturbations extending along a side of the rod which radiate a radar beam when the ends of the rod are coupled between a source of the radar signal and a load. The radiated antenna beam is swept by means of a pair of thin metallic plates which extend along oppositely-disposed sides of the rod and a helically wound biasing coil which surrounds the metallic plates and extends along the rod.

When the radar system front end utilizes a ferrite type circulator device and a ferrite type scanning antenna, these two components are coupled together by a length of dielectric waveguide material which is selected to have a dielectric constant closely matched to that of the ferrite material of the circulator and the antenna to minimize impedance discontinuities and losses. For proper operation, it is important that the magnetic biasing fields of the ferrite circulator device and the ferrite scanning antenna do not interfere or react with each other. In addition, for many millimeter wave applications, such as for target acquisition systems, for example, it is of critical importance that the radar front end portion of the system be of small size and low weight to facilitate mounting in missiles and guided vehicles.

SUMMARY OF THE INVENTION

It is an object of this invention to provide a millimeter wavelength monolithic ferrite device which functions both as a circulator and as an antenna.

It is a further object of this invention to provide a millimeter wavelength monolithic ferrite circulator/antenna device which eliminates the need to use a length of dielectric waveguide to couple ferrite type circulators to ferrite type antennas in radar front end subsystems and which thereby reduces the size and weight of the radar front end system.

It is a still further object of this invention to provide a millimeter wavelength monolithic ferrite circulator-/antenna device for use in radar front end subsystems which increases the efficiency of the subsystem because of lower insertion losses which result from elimination of connecting dielectric waveguide sections and waveguide butt joints.

It is an additional object of this invention to provide a millimeter wavelength monolithic ferrite circulator-/antenna device having magnetic biasing fields for the circulator and antenna portions of the device which do not interfere with each other.

Briefly, the millimeter wavelength monolithic ferrite circulator/antenna device of the invention comprises a four-sided ferrite rod having a substantially rectangular cross-section and an antenna portion and a circulator portion. The antenna portion of the rod has a longitudinally-extending series of longitudinally spaced apart perturbations along a first side of the rod. The perturbations are adapted to radiate millimeter wavelength electromagnetic wave energy when one end of the rod is coupled to a source of such energy. The circulator portion at the said one end of the rod is adapted to selectively couple the rod antenna portion to millimeter wavelength electromagnetic wave energy transmitter and receiver apparatus when the rod circulator portion is magnetically biased in a direction substantially orthogonal to the longitudinal axis of the rod. The said one rod end is shaped as a right prism having prism bases formed by polygonal sections of second and third oppositely-disposed rod sides which are substantially orthogonally disposed with respect to the first rod side, two prism faces formed by rectangular sections of the first rod side and the fourth rod side and having substantially the same size and shape as the cross-section of the rod, and a "phantom" prism face formed by the cross-section of the rod. The circulator/antenna device also comprises circulator magnetic biasing means mounted on the rod circulator portion for applying a dc magnetic field between the prism bases so that the prism faces act as circulator ports.

When the rectangular sections of the first and fourth rod sides forming the two prism faces are inwardly sloping sections which meet at an angle of substantially 60 degrees at the longitudinal axis of the rod and the polygonal sections of the second and third rod sides forming the prism bases are equilateral triangles, the rod circulator portion functions as a Y junction circulator. When the rectangular sections of the first and fourth rod sides forming the two prism faces are sections having a length substantially equal to the width of the second and third rod sides and the polygonal sections of the second and third rod sides forming the prism bases are squares, the rod circulator portion functions as a T junction circulator.

The nature of the invention and other objects and additional advantages thereof will be more readily understood by those skilled in the art after consideration of the following detailed description taken in conjunction with the accompanying drawings.

DESCRIPTION OF THE PREFERRED EMBODIMENT OF THE INVENTION

Figure 1:
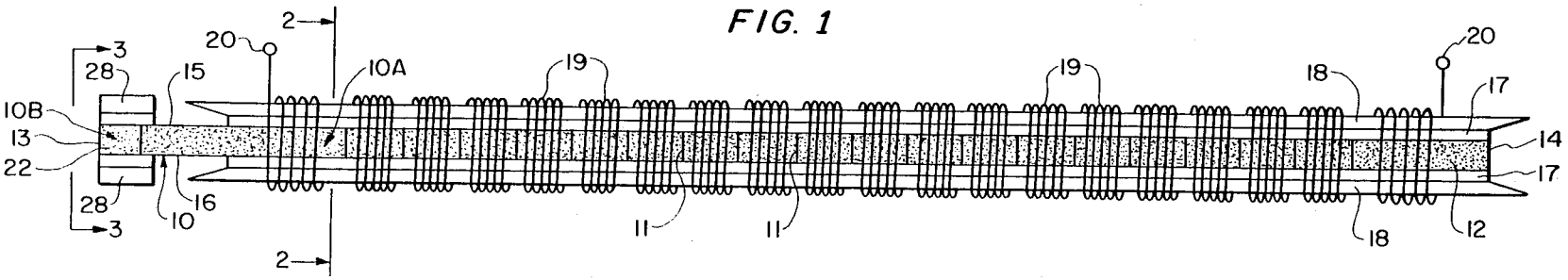
FIG. 1 is a front elevational view of the millimeter wavelength monolithic ferrite circulator/antenna device of the invention.
Figure 2:
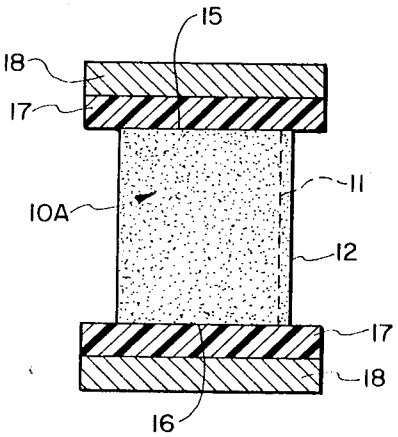
FIG. 2 is a full sectional view of the circulator/antenna device of FIG. 1 taken along the line 2—2 of FIG. 1 with the biasing coil omitted for convenience of illustration.

Referring now to FIGS. 1 and 2 of the drawings, there is shown a monolithic ferrite circulator/antenna device constructed in accordance with the teachings of the present invention comprising a four-sided ferrite rod, indicated generally as 10, having a substantially rectangular cross-section. The rod 10 has an antenna portion, indicated generally as 10A and a circulator portion, indicated generally as 10B. The antenna portion 10A has a longitudinally-extending series of longitudinally-spaced apart perturbations 11 along a first side 12 of the rod. The perturbations 11 are narrow slots which are oriented substantially perpendicular to the longitudinal axis of the rod. When an end 13 of the ferrite rod 10 is coupled to a source of millimeter wavelength electromagnetic wave energy such as that emitted by a radar transmitter, for example, and other end 14 of the rod is coupled to a load (not shown), as understood in the art, the perturbations or slots 11 will emit or radiate millimeter wavelength electromagnetic wave energy from the source so that the rod acts as an antenna. Ferrite rods of this type operate on the so-called "leaky-wave" principle so that the energy radiated from each perturbation or slot is radiated in a direction which is normal to the point of penetration of the perturbation or slot in the rod side 12. By suitably spacing and distributing the perturbations 11 on the rod side 12, the electromagnetic wave energy radiated may be caused to define an antenna beam of desired shape in accordance with known techniques.

The antenna portion 10A of the rod also includes means for scanning the emitted beam from the slots 11 so that the radar beam may be swept. To this end, second and third rod sides 15 and 16, respectively, which are oppositely disposed with respect to each other and which are subtantially orthogonally disposed with respect to the first rod side 12 are provided wih a pair of substrate plates 17 which are fabricated of a low loss plastic having a low dielectric constant, such as the thermoset, cross-linked styrene copolymer, "Rexolite 1422", which is marketed by C-LEC Company of Beverly, N.J., for example. The substrate plates 17 support a pair of metal plates 18 which are fabricated of a material which is a good electrical conductor, such as brass, aluminum or silver, for example. Finally, antenna magnetic biasing means mounted on the antenna rod portion 10A are provided to produce a magnetic field in the ferrite rod 10 along the longitudinal axis of the rod. As seen in FIG. 1, the antenna magnetic biasing means comprises a series of biasing coils 19, each of which is helically wound about the metal plates 18 and the ferrite rod 10 along the antenna portion 10A of the rod. The individual coils 19 are connected in series circuit with each other and are energized by a pair of terminals 20 which may be coupled to an antenna scanning control circuit, not shown. The individual coils 19 of the series of coils are disposed between the perturbations or slots 11 so that they do not interfere with the wave energy radiated from the slots.

The ferrite rod 10 may be fabricated of material, such as nickel zinc ferrite or lithium zinc ferrite, for example, which has a saturation magnetization greater than 3,000 and a dielectric loss tangent less than 0.005. The metal plates 18 on the second and third rod sides 15 and 16 serve to suppress or prevent the Faraday rotation of the electromagnetic wave in the ferrite rod 10 which is produced by the magnetic field produced by the helically wound biasing coils 19 which is directed along the longitudinal axis of the rod. This causes the antenna beam which is emitted by the slots 11 to be swept. A ferrite rod antenna of this construction is shown and described in the aforementioned copending U.S. patent application Ser. No. 640,183 to which reference is made for further details of construction and operation.

Figure 3:
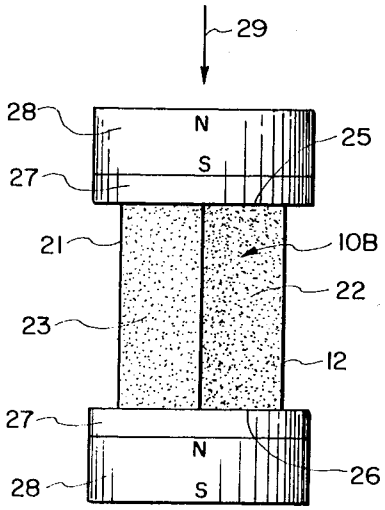
FIG. 3 is an end elevational view of the circulator-/antenna device taken in the direction of the arrows 3—3 in FIG. 1.
Figure 4:
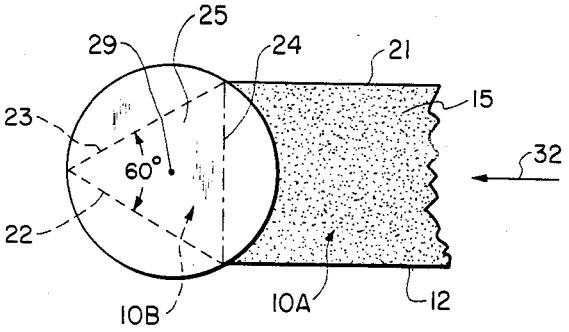
FIG. 4 is a top plan view of the circulator portion and a fragment of the antenna portion of the circulator/antenna device of FIGS. 1-3.

The circulator portion 10B of the ferrite rod 10 is at the rod end 13 which is to be coupled to the millimeter wavelength electromagnetic wave energy transmitter and receiver apparatus. As seen in FIGS. 1, 3 and 4 of the drawings, the first rod side 12 and the oppositely-disposed fourth rod side 21 are each tapered inwardly toward the longitudinal axis of the rod in the circulator portion 10B of the rod so that inwardly sloping, rectangular sections 22 and 23 are formed which meet at an angle of substantially 60 degrees at the longitudinal axis of the rod. The two inwardly sloping sections 22 and 23 may be considered to be two faces of a right prism. If a transverse cross-section of the rod is taken in a plane which is perpendicular to the longitudinal axis of the rod and which passes through the junction lines of the sloping sections 22, 23 with the rod sides 12, 21, it will be seen that a third prism face, herein referred to as a "phantom" prism face which is schematically represented by the dot-dash line 24 in FIG. 4 of the drawings is formed. The phantom prism face 24 will combine with the two prism faces 22 and 23 to form a right prism having prism bases 25 and 26 which are polygonal-shaped sections of the second and third rod sides 15 and 16, respectively. The polygonal sections 25 and 26 thus far described and as shown in FIG. 4 of the drawings are equilateral triangles so that in this embodiment of the invention the rod circulator portion will function as a Y junction circulator when a dc magnetic biasing field is applied between the prism bases 25 and 26.

As seen in FIGS. 1, 3 and 4 of the drawings, the circulator magnetic biasing means may be mounted directly on the rod circulator portion 10B. To this end, a pair of disc-shaped dielectric spacers 27 are bonded directly to the triangular bases 25 and 26 of the prism. A pair of cylindrical permanent magnets 28 having the same polarity orientation, as illustrated, are then bonded to the dielectric spacers 27 to provide a dc magnetic field, indicated schematically by the arrow 29 in FIG. 3, which is normal to the planes of the prism bases and which exists between the prism bases. The diameter of the permanent magnets 28 should be sufficient to cover all of the rod circulator portion 10B. In accordance with well-known principles, the circulator will function as a non-reciprocal coupling device in which energy is transmitted from one of its three prism faces or "ports" to an adjacent port while decoupling the signal from the third port. A clockwise or counterclockwise coupling direction will, of course, depend upon the direction of the applied dc magnetic biasing field 29. The operation of the circulator portion of the device of its invention will be the same as the ferrite circulator shown in said U.S. Pat. No. 4,415,871 to which reference is made for further details of operation and construction.

Figure 5:
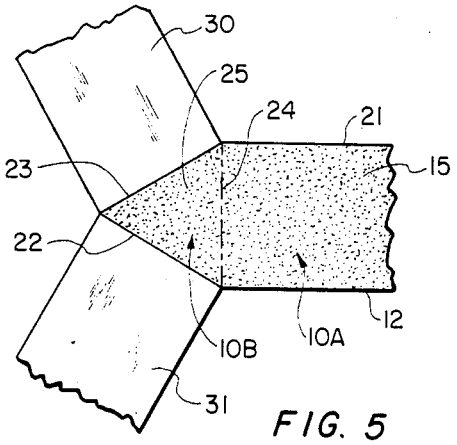
FIG. 5 is a schematic diagram showing the two exposed prism faces of the circulator portion of the circulator/antenna device of FIGS. 1-4 coupled to sections of dielectric waveguide, the circulator magnetic biasing structure being omitted for convenience of illustration.

The Y junction circulator described in FIGS. 1–4 is shown in FIG. 5 as being coupled to two sections of dielectric waveguide 30 and 31. The sections 30 and 31 should each have a cross-sectional area and shape which is the same as the area and shape of the prism faces or ports 22 and 23 for maximum coupling efficiency. The waveguide sections 30 and 31 may be employed to couple the circulator to the transmitter and receiver of a radar set, for example. The phantom prism face, as represented by the dot-dash line 24 also functions to couple the antenna portion of the ferrite rod to the radar transmitter or receiver as the case may be.

Figure 6:
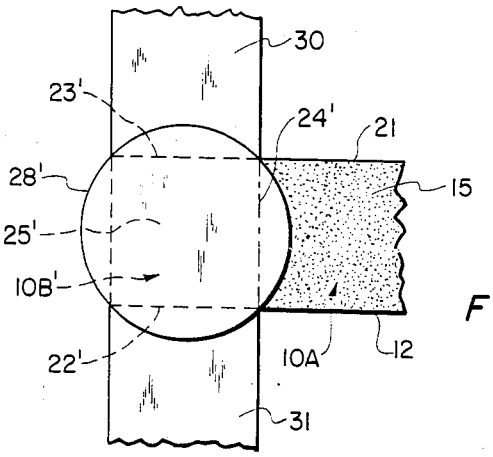
FIG. 6 is a top plan view showing a modified form of the circulator/antenna device of the invention coupled in a T junction circulator configuration.

An alternative embodiment of the circulator/antenna device of the invention is shown in FIG. 6 of the drawings wherein the circulator portion operates as a T junction circulator. In describing this embodiment of the invention, reference numerals with a prime notation will be employed to designate elements which are the same as or substantially the same as the correspondingly numbered elements in the embodiment of the invention shown in FIGS. 1–4 of the drawings. The circulator portion 10B' of the ferrite rod 10 is again a right prism having prism bases 25' and 26' which are formed by polygonal sections of the second and third rod sides 15 and 16, respectively. The two prism faces 22' and 23', however, are rectangular sections of the first and fourth rod sides 12, 21, respectively, which have a length substantially equal to the width of the second and third rod sides 15 and 16, respectively. The polygonal sections of the second and third rod sides, 15 and 16, respectively, are squares so that the prism bases 25' and 26' are squares. The phantom prism face 24' remains the same as the cross-section of the rod so that the three prism faces 22', 23' and 24' which function as the active prism faces or circulator ports have the same shape and size. The circulator magnetic biasing means may again take the form of cylindrical permanent magnets 28' which need only be of sufficient diameter to pass through the four corners of the square and hence to cover the three active circulator faces or ports 22', 23' and 24'. Again, the waveguide sections 30 and 31 which are connected to the circulator ports 22' and 23' should, of course, have the same cross-sectional area as the area of the prism faces 22' and 23' which are in turn the same as the cross-sectional area of the ferrite rod 10. Although an operable T junction circulator can be constructed in this manner, it lacks symmetry around its center and accordingly the characteristics of all three active coupling ports would not be identically the same which could be a disadvantage in some applications.

A circulator/antenna device constructed in accordance with the teachings of the present invention is a monolithic structure which eliminates the need to use a section of dielectric waveguide to connect the input of a ferrite rod antenna to the antenna port of a separate circulator device. This effectively reduces the size and weight of radar front-end subsystems in which such a monolithic ferrite circulator/antenna device is employed and will also increase the efficiency of the front-end subsystem because of lower insertion losses resulting from elimination of the intermediate dielectric waveguide connecting section and the accompanying waveguide butt joints. Furthermore, the dc magnetic biasing field for the circulator portion of the device which is indicated by the arrow 29 in FIG. 3 of the drawings and by the dot 29 in FIG. 4 of the drawings is seen to be orthogonally related to the dc magnetic biasing field produced by the helically wound biasing coils 19 of the antenna portion 10A of the ferrite rod as represented by the arrow 32 in FIG. 4 of the drawings, so that there is no possibility that these two magnetic biasing fields could interfere with each other.

It is believed apparent that many changes could be made in the construction and described uses of the foregoing monolithic ferrite circulator/antenna device and many seemingly different embodiments of the invention could be constructed without departing from the scope thereof. For example, the particular ferrite rod antenna shown and described herein could be replaced by a ferrite rod antenna of different construction. Similarly, the cylindrical permanent magnet biasing arrangement used for the rod circulator portion 10B could be replaced by permanent magnets of other shapes or by a suitably controlled electromagnetic coil biasing means. Accordingly, it is intended that all matter contained in the above description or shown in the accompanying drawings shall be interpreted as illustrative and not in a limiting sense.

What is claimed is:

1. A millimeter wavelength monolithic ferrite circulator/antenna device comprising a four-sided ferrite rod having a substantially rectangular cross-section, said rod having an antenna portion having a longitudinally-extending series of longitudinally-spaced apart perturbations along a first side of the rod for radiating millimeter wavelength electromagnetic wave energy and a circulator portion at one rod end for selectively coupling said rod antenna portion to millimeter wavelength electromagnetic wave energy when said rod circulator portion is magnetically biased in a direction substantially orthogonal to the longitudinal axis of the rod, said one rod end being shaped as a right prism having prism bases formed by polygonal sections of second and third oppositely-disposed rod sides which are substantially orthogonally disposed with respect to said first rod side, two prism faces formed by rectangular sections of said first rod side and the fourth rod side and having substantially the same size and shape as said cross-section of the rod, and a phantom prism face formed by said cross-section of the rod; and circulator magnetic biasing means mounted on said rod circulator portion for applying a dc magnetic field between said prism bases so that said prism faces act as circulator ports.

2. A millimeter wavelength monolithic ferrite circulator/antenna device as claimed in claim 1 wherein said rectangular sections of said first and fourth rod sides forming said two prism faces are inwardly sloping sections which meet at an angle of substantially 60 degrees at said longitudinal axis of the rod, and said polygonal sections of said second and third rod sides forming said prism bases are equilateral triangles, so that said rod circulator portion functions as a Y junction circulator.

3. A millimeter wavelength monolithic ferrite circulator/antenna device as claimed in claim 1 wherein said rectangular sections of said first and fourth rod sides forming said two prism faces are sections having a length substantially equal to the width of said second and third rod sides, and said polygonal sections of said second and third rod sides forming said prism bases are squares, so that said rod circulator portion functions as a T junction circulator.

4. A millimeter wavelength monolithic ferrite circulator/antenna device as claimed in claim 1 wherein said circulator magnetic biasing means comprises permanent magnet means mounted on said prism bases.

5. A millimeter wavelength monolithic ferrite circulator/antenna device as claimed in claim 4 wherein each perturbation of said series of perturbations comprises a narrow slot in said first rod side which is substantially perpendicular to said longitudinal axis of the rod, said series of perturbations are so spaced on said first rod side as to cause the electromagnetic wave energy radiated therefrom to define an antenna beam, and means are provided on said rod antenna portion for scanning the antenna beam radiated by said slots.

6. A millimeter wavelength monolithic ferrite circulator/antenna device as claimed in claim 5 wherein said beam scanning means comprises a pair of substrate plates fabricated of a low loss material having a low dielectric constant, said substrate plates being disposed on said second and third rod sides and extending along the antenna portion of the rod, a pair of metal plates disposed on said substrate plates and extending along the antenna portion of the rod for suppressing Faraday rotation of the millimeter wavelength electromagnetic wave energy in said rod when a magnetic field is applied along the longitudinal axis of the rod, and antenna magnetic biasing means mounted on said antenna rod portion for producing a magnetic field in said rod along the longitudinal axis of the rod to cause scanning of the antenna beam radiated by said slots, whereby the magnetic fields produced by said circulator magnetic biasing means and said antenna magnetic biasing means are orthogonally disposed with respect to each other.

7. A millimeter wavelength monolithic ferrite circulator/antenna device as claimed in claim 6 wherein said rectangular sections of said first and fourth rod sides forming said two prism faces are inwardly sloping sections which meet at an angle of substantially 60 degrees at the longitudinal axis of the rod, and said polygonal sections of said second and third rod sides forming said prism bases are equilateral triangles, so that said rod circulator portion functions as a Y junction circulator.

8. A millimeter wavelength monolithic ferrite circulator/antenna device as claimed in claim 6 wherein said rectangular sections of said first and fourth rod sides forming said two prism faces are sections having a length substantially equal to the width of said second and third rod sides, and said polygonal sections of said second and third rod sides forming said prism bases are squares, so that said rod circulator portion functions as a T junction circulator.

* * * * *